US006161392A

United States Patent [19]

Jirnov et al.

[11] Patent Number: 6,161,392

[45] Date of Patent: Dec. 19, 2000

[54] COMBINED THERMODYNAMIC POWER AND CRYOGENIC REFRIGERATION SYSTEM USING BINARY WORKING FLUID

[76] Inventors: Olga Jirnov; Alexei Jirnov, both of 9105 Braeburn Valley Dr., Apt. 14, Houston, Tex. 77074

[21] Appl. No.: 09/183,845

[22] Filed: Oct. 30, 1998

Related U.S. Application Data

[63] Continuation-in-part of application No. 08/929,294, Sep. 5, 1997.

[51] Int. Cl.[7] ..... F25B 9/00

[52] U.S. Cl. ..... 62/87

[58] Field of Search ..... 62/87, 86

[56] References Cited

U.S. PATENT DOCUMENTS 3,154,928 11/1964 Harmens ..... 62/53

3,992,891 11/1976 Pocrjna ..... 62/53

*Primary Examiner*—William Doerrler

*Assistant Examiner*—Malik N. Drake

*Attorney, Agent, or Firm*—Kenneth A. Roddy

[57] ABSTRACT

A combined thermodynamic power and cryogenic refrigeration system using a first and second (binary) working fluid has a low-temperature closed bottoming cycle and either a closed or open topping cycle. In the bottoming cycle a mixture of a first gas such as helium or hydrogen and a low temperature liquid such as liquefied nitrogen is isothermally compressed and then the liquid content is separated. The separated first gas is heated using heat from a second gas or ambient air expanded in the topping cycle and then the heated first gas is adiabatically expanded and supercooled while performing useful work and thereafter is mixed with the separated liquid to serve as a coolant and facilitate rejection of adiabatic heat and to supplement the cool gas/liquid fed to the compressor and thus completes the bottoming cycle. The bottoming cycle functions to cool the second gas during its compression in the topping cycle. The topping cycles are closed or open modified Brayton cycles. The closed topping cycle uses heat of the ambient air or other low temperature heat source to simultaneously produce cool refrigerated air and power and may function as a heat pump for warming cool ambient air. The open topping cycle may use a low temperature heat source, or a high temperature heat source with regeneration, to simultaneously produce power and cool refrigerated air with high thermal efficiency.

7 Claims, 6 Drawing Sheets

COMBINED THERMODYNAMIC POWER AND CRYOGENIC REFRIGERATION SYSTEM USING BINARY WORKING FLUID

CROSS REFERENCE TO RELATED APPLICATION

This application is a continuation-in-part of U.S. patent application Ser. No. 08/929,294, filed Sep. 5, 1997 pending, which is incorporated herein by reference.

BACKGROUND OF THE INVENTION

1. Field of the Invention

This invention relates generally to heat engines and refrigeration apparatus that utilize bottoming and topping cycles and binary working fluid, and more particularly to a combined thermodynamic power and cryogenic refrigeration system utilizing a binary working fluid and having a low-temperature bottoming cycle and open or closed modified Brayton topping cycles.

2. Brief Description of the Prior Art

It is known that any system operating on a cycle and receiving heat while doing work must also have a heat-rejection process as part of the cycle. Most prior art systems having thermodynamic cycles require two external heat reservoirs. However, a heat-rejection or heat-recuperation process may be made up in closed cycles with only a single external heat reservoir without a second external heat reservoir, provided that the work medium is a combined mixture of a non-condensable first gas such as helium or hydrogen that possesses high heat capacity and a low-temperature liquid such as liquefied nitrogen, methane, water with antifreeze, etc., wherein the low-temperature liquid is used as an internal cold reservoir to carry out the heat-rejection process and the non-condensable first gas is supercooled during adiabatic expansion producing useful work and serves as coolant to heated liquid recovering from an initial condition of the gas/liquid mixture. Therefore, it is possible to construct a heat engine which will do work and exchange heat with a single external heat reservoir. The conversion of the heat energy into another form is appreciably enhanced by employing a binary working fluid in the low temperature closed bottoming cycle for cooling of the working fluid of the open or closed topping before its compression or during the multistage compression with intercooling. Thus, if the closed topping cycle utilizes the cool ambient air as a heat source, it gets cooler and the producing power may be converted into heat by means of a heat pump. The present system is distinguished over the prior art in that in the present system, a portion of the cool air becomes cooler heating another portion of air simultaneously.

Heat engines are known in the art which have combined cycles such as a combination of Brayton and Rankin cycles.

Fruschi, U.S. Pat. No. 5,386,685 discloses a method and apparatus for a combined cycle power plant. Simpkin, U.S. Pat. No. 5,431,016 discloses a high efficiency power generation engine.

One of the principal shortcomings of these combined cycle systems is that they are not capable of cooling air during its compression in the topping Brayton cycle.

The present system utilizes a low-temperature closed bottoming cycle that provides deep cooling of the working fluid of a modified Brayton closed or open topping cycle. In the preferred embodiment of the present system, the low-temperature bottoming cycle utilizes the apparatus shown and described in our commonly-owned U.S. patent Ser. No. 08/929,294, which is hereby incorporated herein by reference. This incorporation-by-reference is for the purpose of simplifying the drawings and descriptions of this invention and, also for the purpose of providing a clear and concise description of this invention.

SUMMARY OF THE INVENTION

It is therefore an object of the present invention to provide a combined thermodynamic power and cryogenic refrigeration system utilizing a binary working fluid which can generate a large amount of refrigeration and power simultaneously.

It is another object of this invention to provide a combined thermodynamic power and cryogenic refrigeration system utilizing a binary working fluid which employ a variety of lower temperature heat sources, including solar, ambient air, geothermal heat, etc.

Another object of this invention is to provide a combined thermodynamic power and cryogenic refrigeration system utilizing a binary working fluid which has applicability as an engine or refrigeration apparatus in industry, as well as applications for outer space and other planets.

Another object of this invention is to provide a combined thermodynamic power and cryogenic refrigeration system utilizing a binary working fluid that may employ a high temperature heat source with regeneration which can generate a large amount of power with a high actual thermal efficiency.

Another object of this invention is to provide a combined thermodynamic power and cryogenic refrigeration system utilizing a binary working fluid wherein a portion of cool ambient air can be allow to cool or heat another portion of air simultaneously by means of a heat pump.

A further object of this invention is to provide a combined thermodynamic power and cryogenic refrigeration system utilizing a binary working fluid which may be effectively used in superconductivity technology.

A still further object of this invention is to provide a combined thermodynamic power and cryogenic refrigeration system utilizing a binary working fluid which does not produce environmentally damaging emissions.

Other objects of the invention will become apparent from to time throughout the specification and claims as hereinafter related.

The above noted objects of the invention are accomplished by a combined thermodynamic power and cryogenic refrigeration system that utilizes a cryogenic refrigeration bottoming cycle operating on a binary working fluid in combination with several different topping cycles. In a first embodiment, the topping cycle is a closed topping cycle, in a second embodiment the topping cycle is an open topping cycle using a low temperature heat source, and in a third embodiment the topping cycle is an open topping cycle using a high temperature heat source with regeneration. The low temperature bottoming cycle functions to cool the working fluid of the topping cycle before its compression or during multistage compression with intercooling.

The apparatus of the bottoming cycle includes a sliding-blade gas/liquid compressor, a sliding-blade expander, a vortex separator, a heat exchanger, a vortex ejector/mixer, gas and liquid storage tanks, temperature and pressure sensors and control means for adjustable controlling the volume of fluids in the system contained within a thermally insulated housing.

In operation of the bottoming cycle, rotation of the gas/liquid compressor rotor draws a cool mixture of a first gas (helium or hydrogen) and low temperature liquid (liquefied nitrogen, methane, water with antifreeze etc.) from the vortex ejector/mixer into the gas/liquid compressor operating chamber. The gas/liquid mixture is isothermally compressed and discharged into the vortex separator where the liquid content of the compressed mixture that rejected adiabatic and waste heat is separated, passed to the vortex ejector/mixer, and mixed with the expanded and supercooled first gas to produce a cool gas/liquid mixture.

The compressed and separated first gas enters the vortex heat exchanger, is isobarically heated using heat of the working fluid of the topping cycle before its compression and then enters the expander operating chamber where it is adiabatic expanded and supercooled doing useful work by simultaneously rotating the expander and gas/liquid compressor rotors. The adiabatically expanded and supercooled first gas with a cryogenic temperature is discharged from the expander and enters the vortex ejector/mixer and mixed with the liquid to serve as a coolant and facilitate rejection of adiabatic and waste heat and supplement the cool gas/liquid mixture which is being fed to the gas/liquid compressor and isothermally compressed to complete the bottoming cycle.

The apparatus of the first closed topping cycle includes a gas compressor, gas expander, heat exchanger, gas storage tank, temperature and pressure sensors and control means for adjustably controlling the volume of fluids in the system.

In operation of the first closed topping cycle, rotation of the gas compressor rotor draws a second gas from the heat exchanger of the bottoming cycle where it is cooled. The second cool gas is compressed in the gas compressor and discharged into the topping cycle heat exchanger where it is isobarically heated using heat of ambient air or other source to produce refrigerated air and then enters the operating chamber of the gas expander where it is adiabatic expanded doing useful work by simultaneously rotating the gas expander and gas compressor rotors. The expanded second gas is discharged from the gas expander into the heat exchanger of the bottoming cycle and is cooled transferring its heat to the working fluid of the bottoming cycle. The expanded and cooled second gas with a cryogenic temperature is discharged from the heat exchanger of the bottoming cycle and is fed to the gas compressor and compressed to complete the closed topping cycle The closed topping cycle may also function as a heat pump for warming cool ambient air by the addition of an air compressor and expansion valve connected with the gas compressor. In this modification, cool ambient air is drawn into the operating chamber of the air compressor upon rotation and it is adiabatically compressed and discharged into the expansion valve which throttles the compressed air and supplies heated air to the user.

The apparatus of the second or open topping cycle that utilizes a low-temperature heat source includes an air compressor, an air expander and a heat exchanger.

In operation of the open topping cycle using a low-temperature heat source, the air compressor draws ambient air through the heat exchanger of the bottoming cycle where it is cooled. The cooled air then enters the air compressor of the open topping cycle where it adiabatically compressed and discharged into the heat exchanger of the open topping cycle where it is isobarically heated using the heat of ambient air or other low temperature heat source to produce a first portion of refrigerated air. The heated air exiting the heat exchanger then enters the air expander and is adiabatically expanded and cooled while performing useful work and is discharged to be used as a second portion of the refrigerated air.

The apparatus of the third or open topping cycle using a high-temperature heat source with regeneration includes an air compressor, a gas expander, a heat exchanger/recuperator, a combustion chamber and a power apparatus.

In operation of the open topping cycle using a high-temperature heat source, the air compressor draws ambient air through the heat exchanger of the bottoming cycle where it is cooled. The cool air is multi-stage compressed with intercooling in the heat exchanger of the bottoming cycle and discharged into the heat exchanger/recuperator of the topping cycle where it is preheated using waste heat and fed to a combustion chamber. The heated air from the combustion chamber enters the gas expander, is adiabatically expanded performing useful work and causing simultaneous rotation of the air compressor rotor. Spent working fluid from the gas expander is supplied to the heat exchanger/recuperator isobarically giving up its waste heat to the compressed air and afterwards is supplied to the heat exchanger of the bottoming cycle of the first embodiment of the system thereby additionally utilizing the remainder heat for the power apparatus of the first embodiment.

DESCRIPTION OF THE PREFERRED EMBODIMENTS

The following description of the bottoming cycle 11 of the present system incorporates by reference the drawings and description of commonly-owned U.S. patent Ser. No. 08/929,294. The present system depicts the apparatus of U.S. patent Ser. No. 08/929,294 schematically. For a detailed description of the particular structure of the apparatus, U.S. patent Ser. No. 08/929,294 may be read in conjunction with the following detailed description of the present system.

Figure 1:
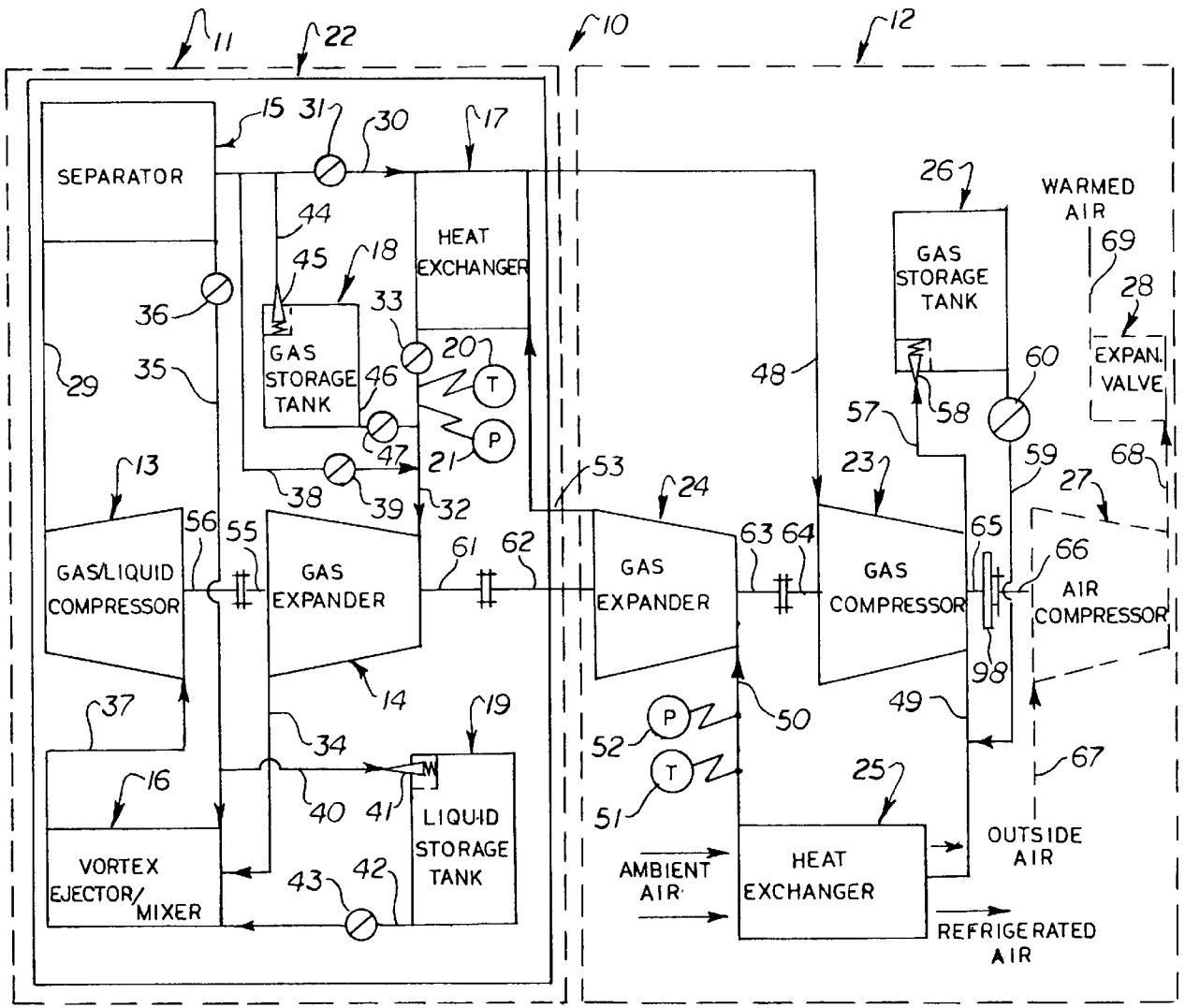
FIG. 1 is a block diagram a first embodiment of the combined thermodynamic power and cryogenic refrigeration system utilizing a binary working fluid having closed bottoming and topping cycles.

FIG. 1 shows a schematic diagram of a first preferred embodiment of the combination power and cryogenic refrigeration system using a binary working fluid in accordance with the present invention. The embodiment of FIG. 1 has a closed bottoming cycle 11 and closed topping cycle 12 represented by dashed line. The apparatus 10 of the bottoming cycle includes a sliding-blade gas-liquid compressor 13, a gas expander 14, a vortex separator 15, a vortex ejector-mixer 16, a heat exchanger 17, a gas storage tank 18, a liquid storage tank 19, and temperature and pressure sensors 20 and 21, which are contained within a thermally insulating housing 22. A non-condensable first gas such as helium or hydrogen far from its saturation point and which possesses high heat capacity is stored in the gas storage tank 18, and a low temperature liquid such as liquefied nitrogen, methane, water with antifreeze, etc., is stored in the liquid storage tank 19 under high pressure.

The flow of the binary working fluids are shown by arrows in FIG. 1 during the operation of the bottoming 11 and topping 12 cycles. As the rotor of the gas-liquid compressor 13 rotates, a mixture of the first gas and low temperature liquid is drawn into the gas-liquid compressor 13 and the mixture is isothermally compressed in the gas-liquid compressor. The compressed first cool gas and liquid mixture is discharged into the vortex separator 15 through a conduit 29 where the cool first gas is separated from the low temperature liquid and supplied to the heat exchanger 17 through a conduit 30 and a throttle 31. The separated first gas is isobarically heated in the heat exchanger using heat of the topping cycle working fluid before its compression and then enters the gas expander 14 through a conduit 32 containing a throttle 33 and temperature sensor 20 and pressure sensor 21 which are disposed below the throttle 33.

During adiabatic expansion and supercooling, the first gas performs useful work by causing simultaneously rotation of the rotors of the gas expander 14 and gas/liquid compressor 13 rotors. The adiabatically expanded and supercooled first gas with a cryogenic temperature is discharged from the gas expander 14 and enters the vortex ejector/mixer 16 through a conduit 34 and is mixed with the liquid from the vortex separator 15 conducted through a conduit 35 and throttle 36 to produce a gas/liquid mixture. The adiabatically expanded and supercooled first gas serves as a coolant and is used to facilitate rejection of adiabatic heat and supplement the cool gas/liquid mixture which is being fed to the gas/liquid compressor 13 through a conduit 37 and isothermally compressed to complete the bottoming cycle. The conduit 32 between the gas expander 14 and the heat exchanger 17 and the conduit 30 between the vortex separator 15 and the heat exchanger 17 are joined together by a bypass conduit 38 containing a throttle 39. The bypass conduit 38 is disposed below the throttles 31 and 33 to conduct flow through the bypass when the throttle 39 is open and the throttles 31 and 33 are closed.

The liquid storage tank 19 has an inlet connected to the conduit 35 between the throttle 36 and vortex ejector/mixer 16 through a conduit 40 and a one-way spring valve 41 and has an outlet connected to the vortex ejector/mixer 16 through a conduit 42 containing a throttle 43.

The gas storage tank 18 has an inlet connected to the conduit 30 between the vortex separator 15 and the throttle 31 through a conduit 44 and one-way spring valve 45 and has an outlet connected to the conduit 32 below a throttle 33 through a conduit 46 containing a throttle 47.

Temperature and pressure sensors 20 and 21 are disposed in conduit 32 adjacent to its juncture with the bypass conduit 38. The temperature and pressure sensors 20 and 21 are connected with the throttles 33, 39, 47, 43, and 31 to control their operation in response to the temperature and pressure in the conduit 32, and thereby regulate the power conditions.

The throttles 33, 39, and 31 control the mode of operation of the heat exchanger 17. Throttle 47 meters out the first gas into the system from the gas storage tank 18. Throttle 43 meters out the liquid into the system from the liquid storage tank 19. Throttle 36 located in the conduit 35 allows additional control of the first gas and liquid distributed from the vortex separator 15 through the conduits 35 and 30.

The spring valves 45 and 41 maintain a predetermined pressure in the gas storage tank 18 and the liquid storage tank 19, respectively.

The shafts 55 and 56 of the rotors of the gas expander 14 and gas/liquid compressor 13 are joined together by splines or other suitable means such that the rotors rotate together.

The apparatus of the closed topping cycle portion 12 of the first embodiment of the system 10 includes a rotary gas compressor 23, a rotary gas expander 24, a heat exchanger 25, a gas storage tank 26, an air compressor 27, and an expansion valve 28.

In operation of the closed topping cycle portion 12, as the rotor of the gas compressor 23 rotates, the second gas (helium or hydrogen) is drawn through the heat exchanger 17 of the bottoming cycle portion 11 whereupon it is cooled and enters the gas compressor 23 of the topping cycle portion through a conduit 48. The cool second gas is adiabatically compressed in the gas compressor 23 and discharged into the heat exchanger 25 through a conduit 49 where it is isobarically heated using the heat of the ambient air or other heat source to produce refrigerated air and then it enters the gas expander 24 through a conduit 50 containing temperature sensor 51 and pressure sensor 52.

The gas storage tank 26 is connected to outlet of gas compressor 23 through a conduit 57 and one-way spring valve 58 and has an outlet connected to the conduit 49 through a conduit 59 containing a throttle 60. The temperature and pressure sensors 51 and 52 are connected with the throttle 60 to control their operation in response to the temperature and pressure in the topping cycle portion 12 of the system 10 and thereby regulate the power condition. The adiabatically expanded second gas does useful work by simultaneously rotating the rotors of the gas expander 24 and gas compressor 23 and is discharged from the gas expander 24 into the heat exchanger 17 of the bottoming cycle portion 11 of the system through a conduit 53. The second gas is cooled in the heat exchanger 17 by transferring its heat to the first gas (working fluid of bottoming cycle) and is fed into the gas compressor 23 of the topping cycle portion 12 through the conduit 48 and is compressed to complete the closed topping cycle.

The shaft 61 of the rotor of the qas/liquid compressor 13 of the bottoming cycle 11, the shafts 62, 63 and 64 of the rotors of the gas expander 24 and gas compressor 23 of the topping cycle 12 are joined together by splines or other suitable means such that the rotors rotate together. A pulley 98 is mounted on the outer end of the shaft 65 of the rotor of the gas compressor 23 for power take off.

The system 10 of FIG. 1 may be serve as a heat pump in the winter and as a cooling system in the summer. That is to say the power of the system 10 may be utilized for warming cool ambient air by means of a heat pump. In functioning as a heat pump, the air compressor 27 and expansion valve 28 (represented in dashed line) are joined into the closed topping cycle portion 12 of the system. To accomplish this, the shaft 66 of the rotor of the air compressor 27 is joined to the pulley 98 such that the gas compressor shaft 65 and air compressor shaft 66 rotate together. When functioning as a heat pump, cool ambient air is drawn into the air compressor 27 through a conduit 67. The cool ambient air is adiabatically compressed in the air compressor 27 and discharged into the expansion valve 28 through a conduit 68 where the compressed air is passed into the atmosphere and the heated air is supplied through a conduit 69 to the users.

Figure 2:
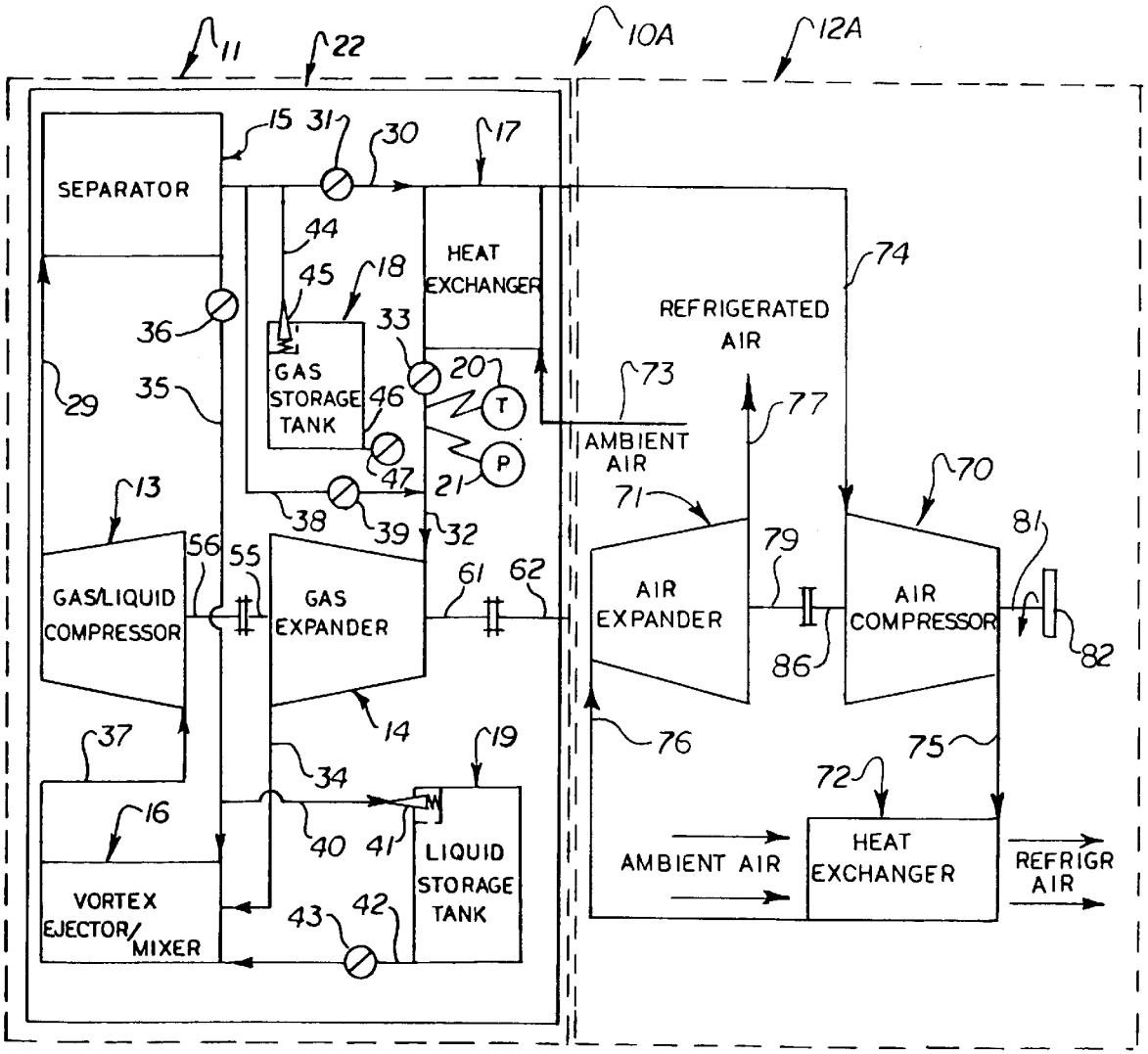
FIG. 2 is a block diagram of the second embodiment of the system having an open topping cycle using a low-temperature heat source.

Referring now to the block diagram FIG. 2 there is shown a second preferred embodiment of the power and cryogenic refrigeration system 10A wherein the topping cycle portion is an open topping cycle 12A using a low temperature heat source. The apparatus of the closed bottoming cycle portion 11 of this embodiment is the same as that described previously.

The apparatus of the open topping cycle portion 12A of the system 10A includes an air compressor 70, a rotary air expander 71, and a heat exchanger 72.

In operation of open topping cycle portion 12A, as the rotor of the air compressor 67 rotates, ambient air is drawn through conduit 73 into the heat exchanger 17 of the bottoming cycle portion 11 whereupon it is cooled and enters the air compressor 70 of the open topping cycle portion 12A through conduit 74. The cool air is adiabatically compressed in the air compressor 70 and discharged into the heat exchanger 72 of the open topping cycle portion 12A through a conduit 75 where it is isobarically heated using the heat of ambient air or other low temperature heat source to produce a first portion of refrigerated air exiting the heat exchanger 72 and then enters the air expander 71 through a conduit 76. The adiabatically expanded and cooled air performs useful work while passing through the air expander 71 and is discharged from the air expander 71 through conduit 77 to be used as a second portion of the refrigerated air. The shaft 61 of the rotor of the qas/liquid compressor 13 of the bottoming cycle portion 11 and the shafts 78, 79 and 80 of the rotors of the air expander 71 and air compressor 70 of the topping cycle portion 12A are joined together by suitable means such that the rotors rotate together. A pulley 82 is mounted on the outer end of the shaft 81 of the rotor of the air compressor 70 for power take off.

Figure 3:
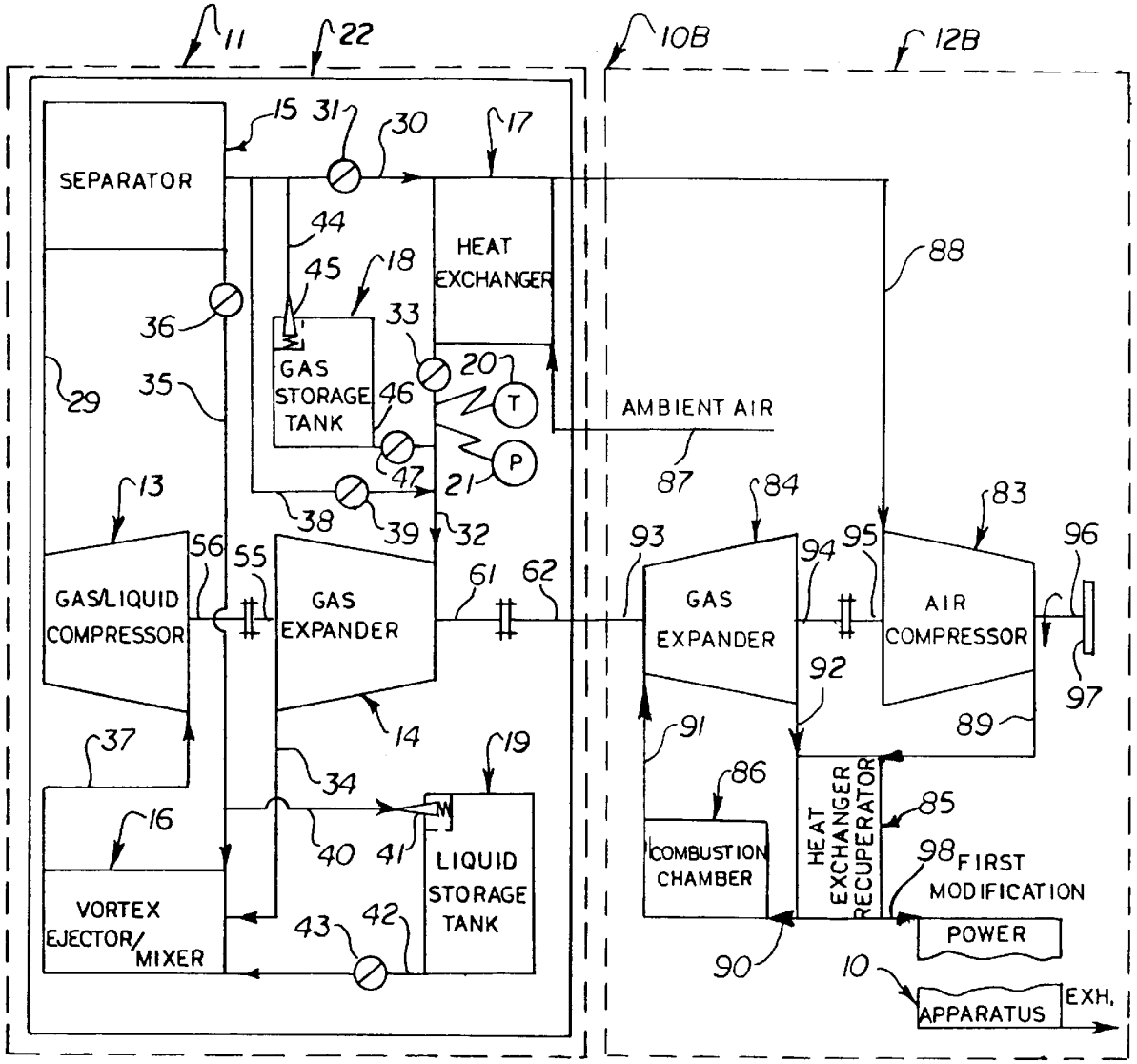
FIG. 3 is a block diagram of the third embodiment of the system having an open topping cycle using a high-temperature heat source.

Referring now to the block diagram of FIG. 3, there is shown a third preferred embodiment of the power and cryogenic refrigeration system 10B wherein the apparatus of the closed bottoming cycle portion 11 is the same as that previously described and the topping cycle portion 12B is an open topping cycle using a high temperature heat source.

The apparatus of the open topping cycle portion part 12B of the system includes an air compressor 83, an air expander 84, a heat exchanger/recuperator 85, and a combustion chamber 86.

In operation of the system 10B, as the rotor of the air compressor 83 of the topping cycle 12B rotates, ambient air is drawn through a conduit 87 into the heat exchanger 17 of the bottoming cycle 11 where it is cooled and enters the air compressor 83 of the topping cycle 12B through conduit 88. The cool air is compressed in the air compressor 83 and discharged through a conduit 89 into the heat exchanger-recuperator 85 where it is preheated using waste heat and passed to the combustion chamber 86 through conduit 90. The heated air from the combustion chamber 86 enters the gas expander 84 through a conduit 91, where it is adiabatically expanded performing useful work and causing simultaneous rotation of the rotors of the gas expander 84 and air compressor 83. Spent working fluid from the expander 84 is supplied to the heat exchanger-recuperator 85 through a conduit 92 and is isobarically cooled by giving up its waste heat to the compressed air. A portion of the exhaust heat from the heat exchanger/recuperator 85 may be used for heating and another portion may be supplied through a conduit 98 to the heat exchanger 25 of the topping cycle 12 of the system of FIG. 1 to be used as a source of heat.

The shaft 61 of the rotor of the gas expander 14 of the bottoming cycle 11 and the shafts 93, 94 and 95 of the rotors of the gas expander 84 and air compressor 83 of the topping cycle 12B are joined together by suitable means such that the rotors rotate together. A pulley 97 is mounted on the outer end of the shaft 96 of the rotor of the air compressor 83 for power take-off.

OPERATION

In operation of the bottoming cycle 11 of the systems 10, 10A, and 10B, at start up, the throttles 31 and 33 are closed to disconnect the heat exchanger 17 and throttles 39, 36, 43 and 47 are opened to allow flow between the chamber of the gas/liquid compressor 13 and chamber of the gas expander 14 through the heat exchanger bypass conduit 38. The shafts 55, 56, 61, 62, 63, 64 and 65 are rotated by the external drive pulley 98. Rotation of the shaft and rotor of the gas/liquid compressor 13 draws a cool mixture of the first gas and liquid from the vortex ejector/mixer 16 into the gas/liquid compressor 13. The gas/liquid mixture is isothermally compressed in the compressor 13 and discharged into the vortex separator 15 where the liquid content of the compressed mixture is separated and passed back to the vortex ejector/mixer 16 to be mixed with the expanded and supercooled first gas discharged from the gas expander 14 and used to produce the cool gas/liquid mixture.

When the steady state of the duty cycle is reached (determined by the temperature and pressure sensors 20 and 21 in conduit 32) the throttles 39, 47 and 43 are closed to shut off flow through the bypass conduit 38 and conduits 42 and 46, and throttles 31 and 35 are opened to allow flow through the heat exchanger 17 and conduits 30 and 32. During operation, the temperature and pressure sensors 20 and 21 control the operation of throttles 31, 33 and 39 to control the heat exchanger 17. The throttle 47 meters out the non-condensed first gas into the system from the gas storage tank 18, throttle 43 meters out liquid into the system from the liquid storage tank 19, and throttle 36 controls the distribution of additional first gas and liquid separated by the vortex separator 15 into the respective conduits.

The non-condensable first gas separated from the mixture in the vortex separator 15 enters the heat exchanger 17 where it is isobarically heated using heat of the working fluid of the topping cycle and then enters the operating chamber of the gas expander 14 where it is adiabatic expanded and supercooled and performs useful work by causing simultaneous rotation of the shafts 55, 56 and 61 and rotors of the gas expander 14 and the gas/liquid compressor 13. The adiabatically expanded and supercooled first gas with a cryogenic temperature is discharged from the gas expander 14 and enters the vortex ejector/mixer 16 to be mixed with the liquid and serve as a coolant to facilitate rejection of waste and adiabatic heat and supplement the cool gas/liquid mixture which is fed to the gas/liquid compressor and isothermally compressed to complete the bottoming cycle.

Figure 1B:
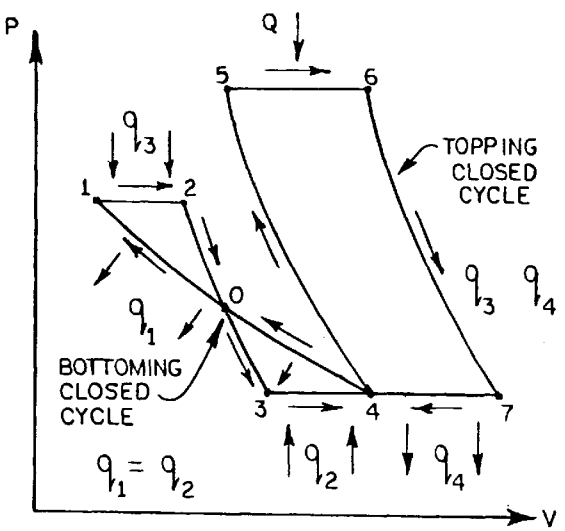
FIG. 1A and 1B are diagrams illustrating the thermodynamic cycles of the first embodiment of the system having closed bottoming and topping cycles.
Figure 1A:
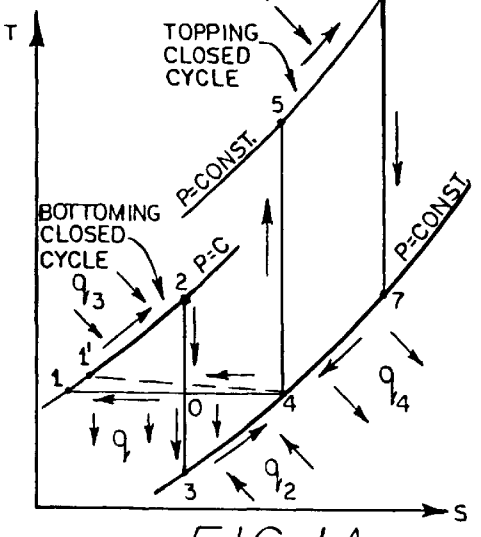

Referring now to the embodiment of FIG. 1 and the thermodynamic diagram of FIG. 1A, as the rotor of the gas/liquid compressor 13 turns, an amount of cool gas/liquid mixture at a temperature $T_4$ and pressure $P_4$ (point 4 in FIG. 1A) is drawn into the operating chamber of the gas/liquid compressor 13 and it is isothermally compressed to a pressure $P_1$ and temperature $T_1$ (point 1 in FIG. 1A) and discharged into the vortex separator 15 where the gas and liquid are divided or stratified by centrifugal force.

The separated first gas is discharged into the heat exchanger 17, where it accepts part of the heat of the working fluid of the topping cycle thereby isobarically heating it ($P_1$=$P_2$) to temperature $T_2$. The compressed and heated first gas enters the operating chamber of the gas expander 14 and is adiabatic expanded from pressure $P_2$ to pressure $P_3$ and supercooled to temperature $T_3$ (point 3 in FIG. 1A) by performing useful work in causing rotation of the rotor of the gas expander 14 and through the shafts 55 and 56 simultaneous rotation of the rotor of the gas/liquid compressor 13 and shaft 61. The expanded and supercooled first gas is exhausted from the gas expander 14 into the vortex ejector-mixer 16. The separated liquid is heated by absorbing waste and adiabatic heat and is also discharged from the vortex separator 15 into the vortex ejector-mixer 16. The expanded and supercooled first gas is mixed and heat exchanged with the liquid which has adsorbed waste and adiabatic heat to renew or supplement the gas/liquid mixture prior to its isothermal compression.

The finely dispersed cool gas/liquid mixture with pressure $P_4$ and temperature $T_4$ is carried away to the gas/liquid compressor operating chamber 13 (point 4 in FIG. 1A) completing the bottoming cycle.

The temperature $T_3$ of the first gas provides a temperature difference $\Delta T=T_4-T_3$ which is sufficient to absorb waste and adiabatic heat by mixing with the liquid and forming the gas/liquid mixture with the temperature $T_4$.

Equality $T_1$=$T_4$ (isothermal compression of the first gas) is based on the assumption that $\Delta T=T_1-T_1'$ is negligible if the pressure ratio $$\pi_1 = \frac{P_1}{P_2}$$

is small and the mass flow rate of liquid and its heat capacity is large.

Under the given condition the dependence of the theoretical specific power $$N_1 \frac{kwt}{\text{kg}}$$

of the bottoming cycle $$\left(\text{mass flow rate of the working fluid first gas } m_1 = 1\frac{\text{kg}}{\text{sec}}\right)$$

is calculated according to the following equation:

$$N_1 = C_{P_1} T_4 \left\{ \frac{T_2}{T_4}\left[1-\left(\frac{1}{\pi_1}\right)^{\frac{k_1-1}{k_1}}\right] - \frac{k_1-1}{k_1}\ln\pi_1 \right\} \quad \text{(Eq. 1)}$$

The quantity $T_4$ can by found from the heating balance that occurs by interchanging of the waste heat ($q_w$) and adiabatic heat ($q_{ad}$) from the liquid to the supercooled first gas:

$$C_{P_1}(T_4-T_3)=q_w+q_{ad}$$

Or $$T_4 - T_2\left(\frac{1}{\pi}\right)^{\frac{k_1-1}{k_1}} = (T_2 - T_4) - \left[\left(T_2 - T_2\frac{1}{\pi\frac{k_1-1}{k_1}}\right) - T_4\cdot\frac{k_1-1}{k_1}\ln\pi_1\right] + T_4\left(\pi_1\frac{k_1-1}{k_1}-1\right) - T_4\cdot\frac{k_1-1}{k_1}\ln\pi_1$$

whence $$\frac{T_2}{T_4} = \frac{\pi_1^{\frac{k_1-1}{k_1}}\left(3-\pi_1^{\frac{k_1-1}{k_1}}\right)}{2} = A \quad \text{(Eq. 2)}$$

Equation (1) and (2) can be reduced to the form $$(N_1)_1 = C_{P_1} T_4 \left\{ A\left[1-\left(\frac{1}{\pi_1}\right)^{\frac{k_1-1}{k_1}}\right] - \frac{k_1-1}{k_1}\ln\pi_1 \right\} \quad \text{(Eq. 3)}$$

Where k=adiabatic exponent of the first gas, $C_{P_1}\frac{\text{kcal}}{\text{kg}-{}^\circ\text{K.}}$ = heat capacity of the first gas at constant pressure, and $\pi_1 = \frac{P_2}{P_3} = \frac{P_1}{P_4}$ = expansion and compression ratios of the first gas.

Referring again to FIG. 1, and FIGS. 1A and 1B and considering the working process of the closed topping cycle of the system 10. As the rotor of the gas compressor 23 turns, the second gas (helium or hydrogen) in drawn through the heat exchanger 17 of the bottoming cycle 11 where it is cooled to temperature $T_4$ and adiabatically compressed to pressure $P_5$. The compressed second gas is isobarically heated in the heat exchanger 25 using the heat of the ambient air (or other heat source) to a temperature $T_6$ and to produce refrigerated air and then it is adiabatically expanded in the gas expander 24 to pressure $P_7$ and temperature $T_7$. The expanded second gas does useful work and is discharged from the gas expander 24 into the heat exchanger 17 and is cooled to temperature $T_4$ transferring its heat to the first gas. The cool second gas is fed to the gas compressor 23 and is adiabatically compressed to the pressure $P_5$ and temperature $T_5$ to complete the closed topping cycle of the system 10.

The dependence of the theoretical specific power $$(N_2)_1 \frac{kwt}{\text{kg}}$$

of the closed topping cycle of the system 10

$$\left(\text{mass flow rate of the working second gas } m_2 = 1\frac{\text{kg}}{\text{sec}}\right)$$

is calculated according to the following equation:

$$(N_2)_1 = C_{P_2}\left\{T_6\left[1-\left(\frac{1}{\pi_2}\right)^{\frac{k_2-1}{k_2}}\right] - T_4\left(\pi_2^{\frac{k_2-1}{k_2}}-1\right)\right\}$$

The total theoretical net specific power of the system 10 equals:

$$\begin{aligned}(\Sigma N)_1 &= M(N_1)_1 + (N_2)_1 \\ &= C_{P_1} M T_4\left\{A\left[1-\left(\frac{1}{\pi_1}\right)^{\frac{k_1-1}{k_1}}\right] - \frac{k_1-1}{k_1}\ln\pi_1\right\} + \\ &\quad C_{P_2}\left\{T_6\left[1-\left(\frac{1}{\pi_2}\right)^{\frac{k_2-1}{k_2}}\right] - T_4\left(\pi_2^{\frac{k_2-1}{k_2}}-1\right)\right\}\end{aligned} \quad \text{(Eq. 4)}$$

Where $M = \frac{m_1}{m_2}$

If $m_2$=1, the equation (4) can be converted to:

$$\begin{aligned}\left(\frac{\Sigma N}{T_6}\right)_1 &= M C_{P_1}\frac{T_4}{T_6}\left\{A\left[1-\left(\frac{1}{\pi_1}\right)^{\frac{k_1-1}{k_1}}\right] - \frac{k_1-1}{k_1}\ln\pi_1\right\} + \\ &\quad C_{P_2}\left\{1-\left(\frac{1}{\pi_2}\right)^{\frac{k_2-1}{k_2}} - \frac{T_4}{T_6}\left(\pi_2^{\frac{k_2-1}{k_2}}-1\right)\right\}\end{aligned} \quad \text{(Eq. 5)}$$

The quantity $$M\frac{T_4}{T_6}$$

characterizes the ability of the bottoming cycle 11 to provide a heat-rejection process as the coolant for the working fluid of the topping cycle 12. The quantity $$\frac{T_4}{T_6}$$

can be found from the heating balance $q_3$=$q_4$ (FIG. 1A), or $$M_1C_{P1}(T_2-T_4)=M_2C_{P2}(T_7-T_4)$$

Substitution from the part of equation $$T_7 = T_6\left(\frac{1}{\pi_2}\right)^{\frac{k_2-1}{k_2}}$$

and $T_2$=$T_4$ A will give $$\frac{T_4}{T_6} = \frac{C_{P_2}}{\pi_2^{\frac{k_2-1}{k_2}}\left[M C_{P_1}(A-1) - C_{P_2}\right]} = B \quad \text{(Eq. 6)}$$

Figure 1D:
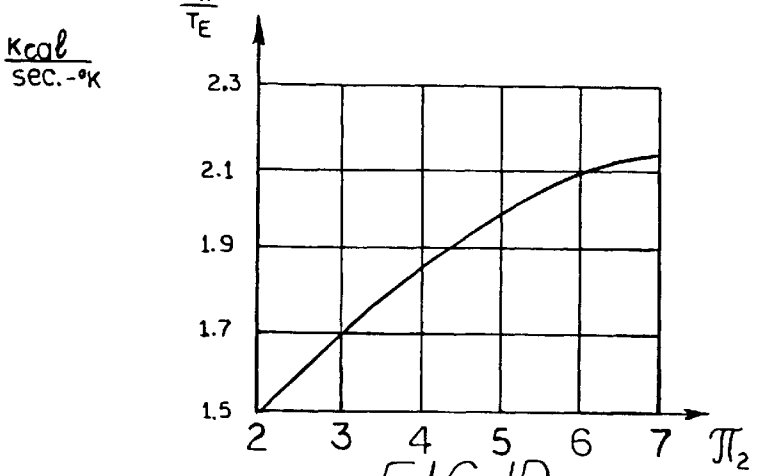
FIG. 1D is a graph showing of the dependence of the theoretical output of the heat pump of the first embodiment of the system on the pressure ratio using a hydrogen-to-helium working fluid composition.
Figure 1C:
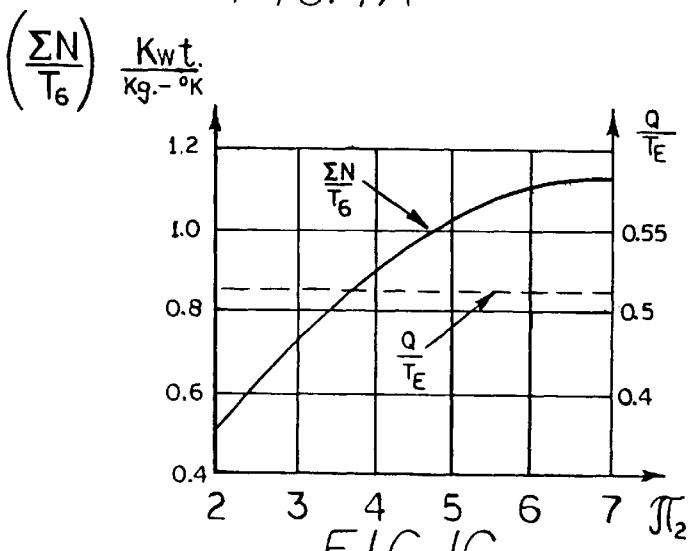
FIG. 1C is a graph showing of the dependence of the theoretical power and the theoretical refrigeration capacity of the first embodiment of the system on the pressure ratio of a hydrogen-to-helium working fluid composition.

Equations (5) and (6) can be reduced to the form $$\begin{aligned}\left(\frac{\Sigma N}{T_6}\right)_1 &= M C_{P_1} B\left\{A\left[1-\left(\frac{1}{\pi_1}\right)^{\frac{k_1-1}{k_1}}\right] - \frac{k_1-1}{k_1}\ln\pi_1\right\} + \\ &\quad C_{P_2}\left\{1-\left(\frac{1}{\pi_2}\right)^{\frac{k_2-1}{k_2}} - B\left(\pi_2^{\frac{k_2-1}{k_2}}-1\right)\right\}\end{aligned} \quad \text{(Eq. 7)}$$

Where $k_2$=adiabatic exponent of the second gas $C_{P_2}\ \frac{\text{kcal}}{\text{kg}-°\text{K.}}$ = heat capacity of the second gas at constant pressure, and $\pi_2 = \frac{P_6}{P_7} = \frac{P_5}{P_4}$ = expansion and compression ratios of the second gas FIG. 1C is a graph showing the dependence of the quantity $$\left(\frac{\Sigma N}{T_6}\right)_1 \frac{kwt}{\text{kg}-°\text{K.}}$$

(represented in full line) on the pressure ratio of the second gas by the optimal pressure ratio of the first gas $\pi_1$=2, M=3 and $$m_2 = 1\frac{\text{kg}}{\text{sec}}$$

for a hydrogen-to-helium gas composition.

If the system uses heat of the ambient air, the theoretical specific heat capacity $$\left(\frac{Q}{T_E}\right)_1 \frac{\text{kcal}}{\text{sec}-°\text{K.}}$$

in that case may be calculated according to the following equation:

$$\left(\frac{Q}{T_E}\right)_1 = C_{P_2}\left(1 - B\pi_2^{\frac{k_2-1}{k_2}}\right)$$

Where $T_E$ ° k=the ambient air temperature.

FIG. 1C shows, in dashed lines, the dependence of the quantity $$\left(\frac{Q}{T_E}\right)_1 \frac{\text{kcal}}{\text{sec}-°\text{K.}}$$

on the pressure ratio $\pi_2$.

In order to utilize the produced power of the system 10 as a heat pump, the shaft 66 of the rotor of the air compressor 27 is joined to the pulley 98 such that the gas compressor shaft 65 and air compressor shaft 66 rotate together. When functioning as a heat pump, cool ambient air is drawn into the air compressor 27 and it is adiabatically compressed and discharged into the expansion valve 28 where it may be passed to the atmosphere and/or supplied to users as warm air. The specific output of this heat pump operation (mass flow rate of the warmed air $$m_{air} = 1\frac{\text{kg}}{\text{sec}}$$

may be defined as:

$$\frac{T_W}{T_E} = \frac{\left(\frac{\Sigma N}{T_E}\right)_1}{C_{P_{air}}} + 1$$

Where $T_W$=the warmed supply air temperature $T_E$ °k=the outside air temperature, and $$C_{P_{air}}\frac{\text{kcal}}{\text{kg}-°\text{K.}} = \text{heat capacity of the air at constant pressure.}$$

FIG. 1D is a graph showing the dependence of the quantity $$\frac{T_W}{T_E}$$

on the pressure ratio $\pi_2$ for a hydrogen-to-helium gas composition.

Figure 2A:
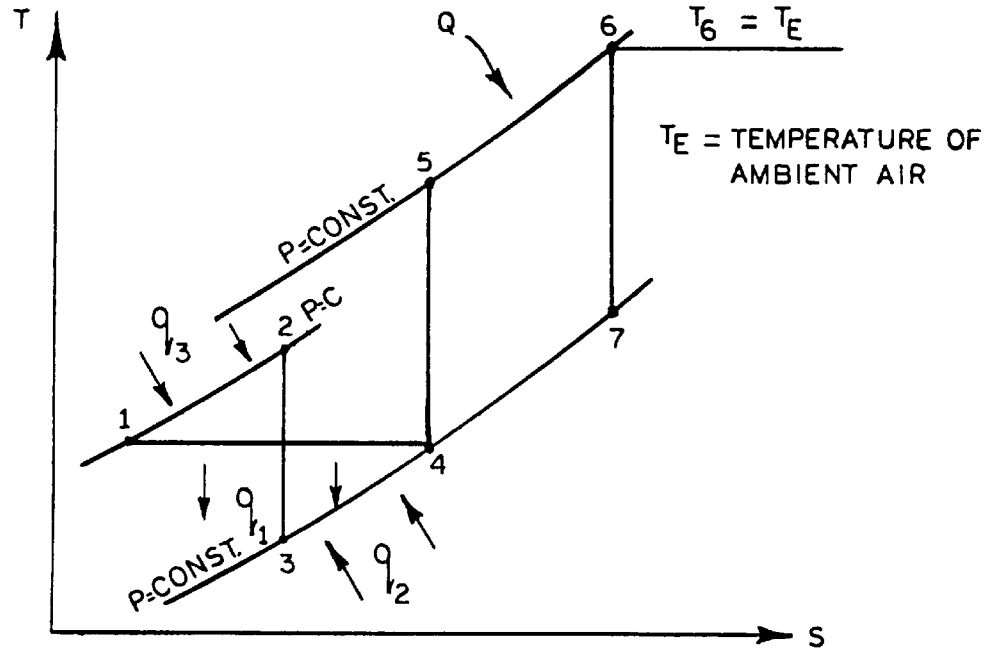
FIG. 2A is a diagram illustrating the thermodynamic cycles of the second embodiment of the system.

Referring now to FIG. 2 showing the embodiment 10A having the same closed bottoming cycle 11 and the open topping cycle 12A using a low temperature heat source, and to FIG. 2A showing the thermodynamic diagram of the working process of the open topping cycle. As the rotor of the air compressor 70 turns, the ambient air with the temperature $T_E$=$T_6$ is drawn through the heat exchanger 17 of the bottoming cycle 11 where it is cooled to temperature $T_4$ and adiabatically compressed to pressure $P_5$. The compressed air is isobarically heated in the heat exchanger 72 using the heat of the ambient air (or other low temperature heat source) to temperature $T_6$ and to produce a first portion of refrigerated air $Q_1$ and then it is adiabatically expanded in the air expander 71 to pressure $P_7$ and temperature $T_7$ while performing useful work. The expanded and cooled air is discharged from the air expander 71 as a second portion $Q_2$ of the refrigerated air.

The dependence of the quantity $$\left(\frac{\Sigma N}{T_E}\right)_2$$

of the system 10A $$\left(\text{mass flow rate of the air as the second gas of the working fluid } m_2 = 1\frac{\text{kg}}{\text{sec}}\right)$$

is calculated like the quantity $$\left(\frac{\Sigma N}{T_6}\right)_1$$

of equation (5) above, but the amount $T_6$ can be found from the heating balance $$M\,C_{P_1}(T_2-T_4)=C_{P_2}(T_E-T_4)$$

or $$\frac{T_4}{T_E} = \frac{C_{P_2}}{M\,C_{P_1}(A-1)+C_{P_2}} = D \qquad \text{(Eq. 8)}$$

Equation (5) and (8) can be reduced to the form $$\left(\frac{\Sigma N}{T_E}\right)_2 = M\,C_{P_1}D\left\{A\left[1-\left(\frac{1}{\pi_1}\right)^{\frac{k_1-1}{k_1}}\right]-\frac{k_1-1}{k_1}\ln\pi_1\right\}+ C_{P_2}\left[1-\left(\frac{1}{\pi_2}\right)^{\frac{k_2-1}{k_2}}-D\left(\pi_2^{\frac{k_2-1}{k_2}}-1\right)\right]$$

Figure 2B:
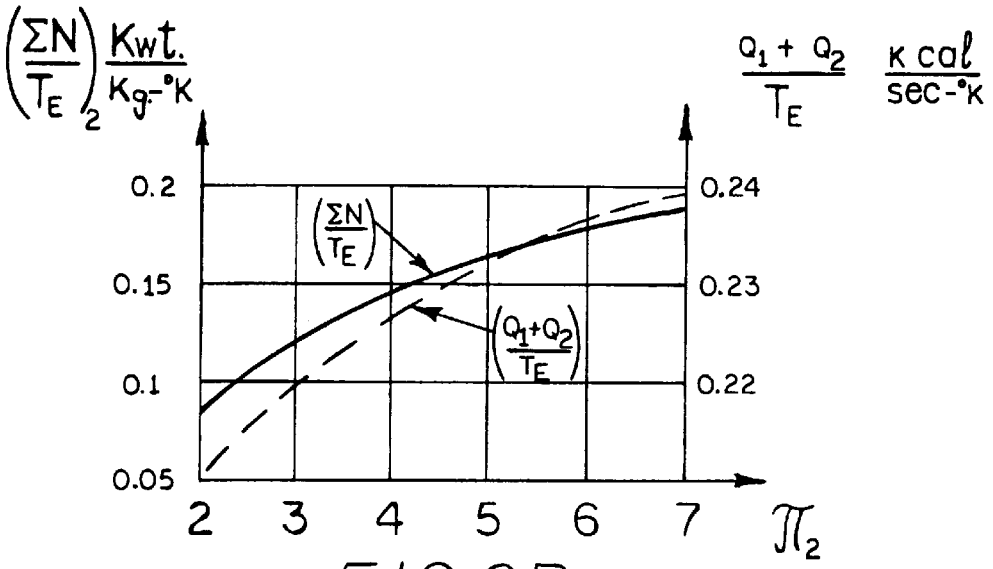
FIG. 2B is a graph showing of the dependence of the theoretical power and the theoretical refrigeration capacity of the second embodiment of the system on the pressure ratio using a hydrogen-to-helium working fluid composition.

FIG. 2B shows the the dependence of the quantity $$\left(\frac{\Sigma N}{T_E}\right)_2 \frac{kwt}{\text{kg}-°\text{K.}}$$

on the pressure ratio $\pi_2$ of the second gas (air) for a helium-to-air gas composition by the pressure ratio ($\pi_1$=2, M=5, $$m_2 = 1\frac{\text{kg}}{\text{sec}}.$$

The theoretical total specific heat capacity $$\left(m_2 = 1\frac{\text{kg}}{\text{sec}}\right)$$

may be calculated according to the following equation $$Q_1+Q_2=C_{P_{air}}[(T_E-T_7)+(T_E-T_5)]$$

substitution from part of the equation $$T_7 = T_E\left(\frac{1}{\pi_2}\right)^{\frac{k_2-1}{k_2}}$$

and $$T_5 = T_E D\pi_2^{\frac{k_2-1}{k_2}}$$

will give $$\frac{Q_1+Q_2}{T_E} = C_{P_{air}}\left[2-\left(\frac{1}{\pi_2}\right)^{\frac{k_2-1}{k_2}} - D\pi_2^{\frac{k_2-1}{k_2}}\right]$$

FIG. 2B also shows the dependence of the quantity $$\frac{Q_1+Q_2}{T_E}\frac{\text{kcal}}{\text{sec}-°\text{K.}}$$

on the pressure ratio $\pi_2$ of the second gas (air) for a helium-to-air composition by the value of the pressure ratio $\pi_1$=2, M=5 and $$m_2 = 1\frac{\text{kg}}{\text{sec}}.$$

Figure 3A:
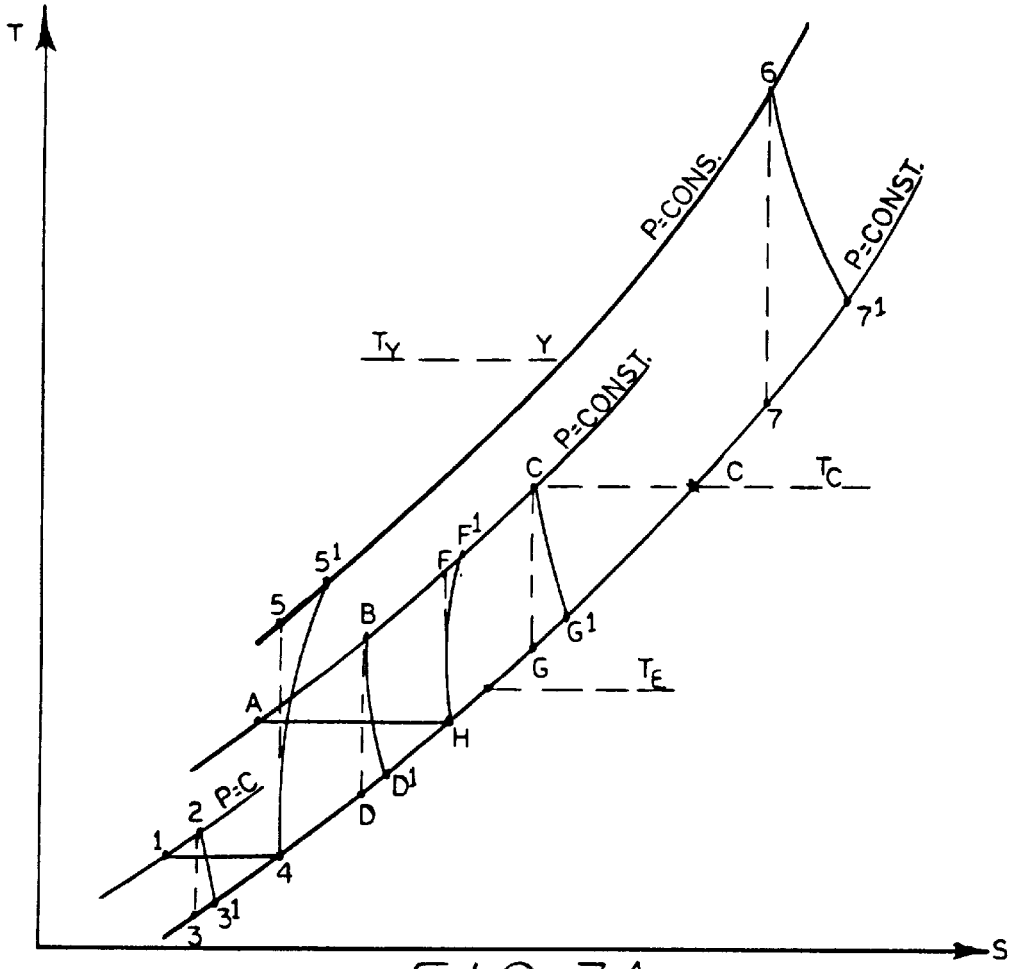
FIG. 3A is a diagram illustrating the thermodynamic cycles of the third embodiment of the system having an open topping open cycle using a high temperature heat source with double utilization of waste heat.

Referring now to the third embodiment 10B of FIG. 3 having the previously described closed bottoming cycle 11 and an open topping cycle 12B using a high temperature heat source and also referring to FIG. 3A, the working process of the open topping cycle 12B will be described.

As the rotor of the air compressor 83 of the topping cycle 12B rotates, ambient air with the temperature $T_E$ is drawn through the heat exchanger 17 of the bottoming cycle 11 where it is cooled to temperature $T_4$ then compressed to pressure $P_5$ and temperature $T_5'$. The compressed air is discharged into the heat exchanger/recuperator 85 where it is preheated to temperature $T_Y$ using waste heat and passed to the combustion chamber 86 where it is heated to temperature $T_6$. The heated and compressed air from the combustion chamber 86 enters the gas expander 84 where it is adiabatically expanded to pressure $P_7$ and temperature $T_7'$ performing useful work and causing simultaneous rotation of the rotors of the gas expander 84 and air compressor and pulley 97. Spent working fluid from the gas expander 84 is supplied to the heat exchanger/recuperator 85 giving up its waste heat to the compressed air and supplied at temperature $T_C$ to the heat exchanger 25 of the topping cycle 12 of the system of FIG. 1 to be used as a source of heat and is discharged through an exhaust port at a temperature $T_G'$.

The actual specific total power of the system 10B of the embodiment of FIG. 3

$$\left(\text{mass flow rate of the air } m_2 = 1\frac{\text{kg}}{\text{sec}}\right)$$

may be expressed as:

$$(\Sigma N)_A = M\,C_{P_1}T_4\left[\eta_e A\left(1-\frac{1}{\pi_1^{\frac{k_1-1}{k_1}}}\right)-\frac{1}{\eta_C}\frac{k_1-1}{k_1}\ln\pi_1\right]+$$
$$C_{P_2}\left[\eta_e T_6\left(1-\frac{1}{\pi_2^{\frac{k_2-1}{k_2}}}\right)-\frac{1}{\eta_C}T_4\left(\pi_2^{\frac{k_2-1}{k_2}}-1\right)\right]+(\Sigma N)_{1A}$$

The amount M can be calculated from the heating balance $$C_{P_1}M(T_2-T_4) = C_{P_2}(T_E-T_4) \text{ or } M = \frac{T_E-T_4}{T_4(A-1)}\cdot\frac{C_{P_2}}{C_{P_1}}$$

The actual thermal efficiency $(\pi_T)_A$ of the system 10B when $m_2$=1 can be calculated:

$$(\eta_T)_A = \frac{(\Sigma N)_A}{(T_6-T_Y)\cdot C_{P_2}}$$

Where $T_Y=\eta_r(T_7'-T_5')+T_5'$

Substitution from the part of the equation $$T_7' = T_6-\eta_e T_6\left(1-\frac{1}{\pi_2^{\frac{k_2-1}{k_2}}}\right) \text{ and}$$

$$T_5' = \frac{1}{\eta_C}T_4\left(\pi_2^{\frac{k_2-1}{k_2}}-1+\eta_C\right)$$

will give $$T_Y = \eta_r\left\{T_6\left[1-\eta_e\left(1-\frac{1}{\pi_2^{\frac{k_2-1}{k_2}}}\right)\right]-\frac{1}{\eta_C}T_4\left(\pi_2^{\frac{k_2-1}{k_2}}-1+\eta_C\right)\right\}+$$
$$\frac{1}{\eta_C}T_4\left(\pi_2^{\frac{k_2-1}{k_2}}-1+\eta_C\right)$$

Where $\eta_r$=efficiency of the regenerator $\eta_e$=turbine efficiency $\eta_C$=compressor efficiency, and $\eta_E$=temperature of the ambient air.

Figure 3B:
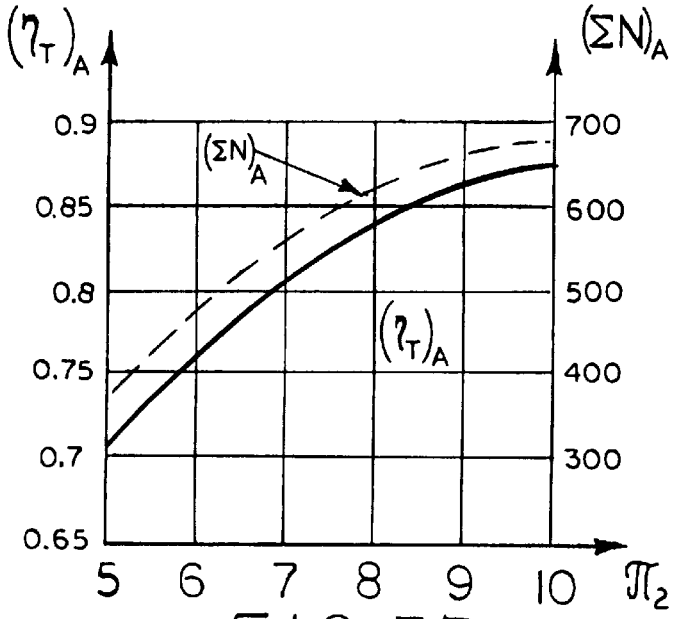
FIG. 3B is a graph showing of the dependence of the actual power and actual thermal efficiency of the third embodiment of the system on the pressure ratio using helium as a working fluid of the bottoming cycle.

FIG. 3B is a graph showing the dependence of the quantity $$(\Sigma N)_A\frac{kwt}{\text{kg}},$$

, represented by dashed line, and of the quantity $(\eta_T)_A$, represented in full line, on the pressure ratio $\pi_2$ for a helium-to-air gas composition by the pressure ratio $\pi_{1=2}$; $T_6$=1500° k.; $\eta_e$=0.9; $\eta_c$=0.9; $\eta_r$=0.9; $T_4$=80° k.; and $T_E$=291° k.

Although a portion of the remainder of heat in the topping cycle 12B in the embodiment 10B of the present system is described as being supplied to the heat exchanger 25 of the topping cycle 12 of the first embodiment 10, it should be understood that the remainder of waste heat may be utilized in various other thermodynamic cycles.

While this invention has been described fully and completely with special emphasis upon preferred embodiments, it should be understood that, within the scope of the appended claims, the invention may be practiced otherwise than specifically described herein.

What is claimed is:

1. A method for transforming thermal energy into mechanical energy while simultaneously producing refrigerated air utilizing binary working fluids, comprising:

introducing a first gas/liquid working fluid mixture of a non-condensable first gas having high heat capacity and a low temperature liquid into a low-temperature closed bottoming cycle;

introducing a second working fluid gas into a topping cycle and compressing and expanding said second working fluid gas in said topping cycle to produce power;

isothermally compressing, isobarically heating, and adiabatically expanding said first working fluid mixture in said low-temperature closed bottoming cycle to produce a refrigerant; and utilizing said refrigerant produced in said low-temperature bottoming cycle to cool said second working fluid gas of said topping cycle and to facilitate rejection of waste heat.

2. The method according to claim 1, wherein said steps of isothermally compressing, isobarically heating, and adiabatically expanding said gas/liquid mixture in said low-temperature closed bottoming cycle comprises the steps of:

introducing said gas/liquid mixture into a rotary gas/liquid compressor having a rotor and isothermally compressing it therein;

separating said isothermally compressed gas/liquid mixture into a non-condensable first gas component having a low boiling temperature and high heat capacity and a liquid component;

isobarically heating said separated non-condensable gas component in a heat exchanger having a second gas as a heat source thereby cooling said second gas to produce a cool refrigerated working fluid to be used for said second working fluid gas of said topping cycle and to facilitate rejection of waste heat of said topping cycle;

discharging said isobarically heated first gas component of said first gas/liquid working fluid from said heat exchanger into a rotary gas expander having a rotor operatively connected with said rotary gas/liquid compressor rotor;

adiabatically expanding said first gas component in said rotary gas expander to simultaneously rotate said gas expander rotor and said rotary gas/liquid compressor rotor and produce useful work and thereby extract heat from said adiabatically expanded first gas component to cool it to a temperature below the boiling point of said liquid component and facilitate rejection of waste heat from said bottoming cycle;

discharging a portion of said adiabitaclly expanded cooled first gas component from said rotary gas expander into a vortex ejector/mixer; and introducing a portion of said separated liquid component into said vortex ejector/mixer and mixing it with said expanded cool first gas component to serve as a coolant for said liquid component and to supplement said gas/liquid mixture that is introduced into said rotary gas/liquid compressor for isothermal compression.

3. The method according to claim 2, wherein said steps of compressing and expanding said second working fluid gas in said topping cycle comprise the steps of:

drawing said cooled second working fluid gas from said heat exchanger of said bottoming cycle and introducing it into a topping cycle rotary gas compressor having a rotor and compressing it therein;

isobarically heating said compressed second gas in a topping cycle heat exchanger having a heat source and ambient air passing therethrough to cool said ambient air and produce cool refrigerated air therefrom;

discharging said isobarically heated second working fluid gas from said topping cycle heat exchanger into a topping cycle rotary gas expander having a rotor operatively connected with said topping cycle rotary gas compressor rotor and said rotary gas expander rotor and said gas/liquid compressor rotor of said bottoming cycle; and expanding said second working fluid gas in said topping cycle rotary gas expander to simultaneously rotate said topping cycle gas expander rotor, said topping cycle gas compressor rotor and said gas expander rotor and said gas/liquid compressor rotor of said bottoming cycle to produce useful work.

4. The method according to claim 3 comprising the further steps of:

drawing a portion of cool outside air into a topping cycle rotary air compressor having a rotor connected with said topping cycle gas compressor rotor to rotate therewith and adiabatically compressing it therein;

discharging said adiabatically compressed air into expansion valve means for throttling said warm air to atmospheric pressure to produce warm air.

5. The method according to claim 2, wherein said steps of compressing and expanding said second working fluid gas in said topping cycle comprises the steps of:

drawing said cooled ambient air from said bottoming cycle heat exchanger and introducing it into a topping cycle rotary air compressor having a rotor and compressing it therein;

isobarically heating said compressed air in a topping cycle heat exchanger having ambient air passing therethrough to cool said ambient air passing through said topping cycle heat exchanger and produce a first portion of refrigerated air therefrom;

discharging said isobarically heated and compressed air from said topping cycle heat exchanger into a topping cycle rotary air expander having a rotor operatively connected with said topping cycle rotary air compressor rotor and said gas expander and said gas/liquid compressor rotor of said bottoming cycle; and adiabatically expanding said heated and compressed air in said topping cycle rotary air expander to simultaneously rotate said topping cycle air expander rotor and said topping cycle rotary air compressor rotor to produce useful work and thereby extract heat from said adiabatically expanded air to produce a second portion of refrigerated air therefrom.

6. The method according to claim 2, wherein said steps of compressing and expanding said second working fluid of said topping cycle comprises the steps of:

drawing said cooled ambient air from said bottoming cycle heat exchanger and introducing it into a topping cycle rotary air compressor having a rotor and compressing it therein;

isobarically preheating said compressed air in a topping cycle heat exchanger/recuperator using waste heat;

isobarically heating said compressed and preheated air in a topping cycle combustion chamber;

discharging said isobarically heated and compressed air from said topping cycle combustion chamber into a topping cycle rotary gas expander having a rotor connected with said topping cycle rotary air compressor rotor;

adiabatically expanding said isobarically heated and compressed air in said topping cycle rotary gas expander to simultaneously rotate said topping cycle gas expander rotor and said topping cycle air compressor rotor to produce useful work;

discharging a first portion of spent expanded air from said topping cycle gas expander into said topping cycle heat exchanger/recuperator to be used as said waste heat to produce said preheated air; and discharging a second portion of said spent expanded air from said topping cycle heat exchanger/recuperator into a thermodynamic power system utilize the remainder of waste heat.

7. A method for transforming thermal energy into mechanical energy while simultaneously producing refrigerated air utilizing binary working fluids, comprising:

introducing a first gas/liquid working fluid mixture of a non-condensable first gas having high heat capacity and a low temperature liquid into a low-temperature closed bottoming cycle;

introducing a second working fluid gas into a topping cycle and compressing and expanding said second working fluid gas in said topping cycle to produce power;

polytropically compressing, isobarically heating, and adiabatically expanding said first working fluid mixture in said low-temperature closed bottoming cycle to produce a refrigerant; and utilizing said refrigerant produced in said low-temperature bottoming cycle to cool said second working fluid gas of said topping cycle and to facilitate rejection of waste heat.

* * * * *